US009383084B2

(12) United States Patent
Ter-Hovhannisyan

(10) Patent No.: US 9,383,084 B2
(45) Date of Patent: Jul. 5, 2016

(54) MOUNTING SYSTEM FOR AN INDUSTRIAL LIGHT

(71) Applicant: LIGHT EMITTING DESIGN, INC., Burbank, CA (US)

(72) Inventor: Zorak Ter-Hovhannisyan, Burbank, CA (US)

(73) Assignee: Light Emitting Design, Inc., Burbank, CA (US)

( * ) Notice: Subject to any disclaimer, the term of this patent is extended or adjusted under 35 U.S.C. 154(b) by 136 days.

(21) Appl. No.: 14/311,636

(22) Filed: Jun. 23, 2014

(65) Prior Publication Data

US 2014/0301076 A1 Oct. 9, 2014

Related U.S. Application Data

(63) Continuation-in-part of application No. 13/559,172, filed on Jul. 26, 2012, now Pat. No. 8,757,842, which is a continuation of application No. 12/819,572, filed on Jun. 21, 2010, now Pat. No. 8,272,765.

(51) Int. Cl.

| | |
|---|---|
| ***F21V 17/16*** | (2006.01) |
| ***F21V 21/08*** | (2006.01) |
| ***F21K 99/00*** | (2016.01) |
| ***F21V 5/04*** | (2006.01) |
| ***F21V 29/00*** | (2015.01) |
| ***F21S 8/00*** | (2006.01) |
| ***F21V 3/04*** | (2006.01) |
| ***F21V 17/14*** | (2006.01) |
| ***F21V 29/77*** | (2015.01) |
| ***F21V 29/83*** | (2015.01) |
| *F21Y 105/00* | (2016.01) |

(52) U.S. Cl.

CPC . *F21V 17/16* (2013.01); *F21K 9/30* (2013.01); *F21S 8/03* (2013.01); *F21V 3/049* (2013.01); *F21V 5/04* (2013.01); *F21V 17/14* (2013.01); *F21V 21/08* (2013.01); *F21V 29/004* (2013.01); *F21V 29/773* (2015.01); *F21V 29/83* (2015.01); *F21Y 2105/001* (2013.01)

(58) Field of Classification Search

CPC ..... F21K 9/30; F21S 8/03; F21V 3/049; F21V 5/04; F21V 17/14; F21V 17/16; F21V 21/08; F21V 29/004; F21V 29/83; F21V 29/773; F21Y 2105/001

See application file for complete search history.

(56) References Cited

U.S. PATENT DOCUMENTS

| | | | | |
|---|---|---|---|---|
| 6,059,238 A * | 5/2000 | Reynolds | ..... | B60N 2/46 16/229 |
| 8,125,125 B2 | 2/2012 | Liu et al. | | |
| 8,272,765 B2 | 9/2012 | Ter-Hovhannisyan | | |

(Continued)

*Primary Examiner* — Stephen F Husar
(74) *Attorney, Agent, or Firm* — Kelly & Kelly, LLP

(57) ABSTRACT

A system for mounting an industrial light to a fixed surface includes a plurality of spring-loaded pins extending from one of either the industrial light or the fixed surface, and a mounting bracket associated with the other of either the industrial light or the fixed surface. The mounting bracket includes an engagement aperture corresponding to each of the plurality of spring-loaded pins, a retainment aperture associated with each engagement aperture, and an inclined channel connecting each engagement aperture with its associated retainment aperture. A head of each of the spring-loaded pins is inserted through a corresponding one of the engagement apertures and then moved through the associated inclined channel until it is seated within the associated retainment aperture, in order to removably attach the industrial light to the mounting bracket.

23 Claims, 11 Drawing Sheets

(56) References Cited

U.S. PATENT DOCUMENTS

| | | | | |
|---|---|---|---|---|
| 8,757,842 | B2 * | 6/2014 | Ter-Hovhannisyan | F21V 29/004 165/80.3 |
| 2003/0230765 | A1 | 12/2003 | Dry | |
| 2010/0102694 | A1 | 4/2010 | Shin | |
| 2010/0296272 | A1 | 11/2010 | Roos et al. | |
| 2011/0025211 | A1 | 2/2011 | Bae | |
| 2011/0050070 | A1 | 3/2011 | Pickard | |
| 2011/0260599 | A1 | 10/2011 | Qiu | |

* cited by examiner

MOUNTING SYSTEM FOR AN INDUSTRIAL LIGHT

RELATED APPLICATION

This application is a continuation-in-part of Ser. No. 13/559,172, filed Jul. 26, 2012 now U.S. Pat. No. 8,757,842, issued Jun. 24, 2014, which is a continuation of Ser. No. 12/819,572, filed Jun. 21, 2010, now U.S. Pat. No. 8,272,765, issued Sep. 25, 2012.

FIELD OF THE INVENTION

The present invention relates to a mounting system for an industrial light. More particularly, the invention relates to a mounting system for an improved industrial light having an inner heat sink coupled to a plurality of outwardly extending cooling fins encased by an outer heat sink, thereby improving heat dissipation from a heat generating device by increasing the amount of heat sink surface area subject to air convection.

BACKGROUND OF THE INVENTION

Heat sinks are components or assemblies designed to transfer energy away from a device generating heat. Oftentimes, heat sinks make use of a fluid medium such as water or air to facilitate heat exchange to the surrounding environment. Some examples of heat sinks used as a means for heat transfer include refrigeration systems, air conditioning systems, radiators, etc. Other types of heat sinks are used to cool electric devices, such as circuit boards, computer chips, diodes, and other higher powered optoelectronic devices such as lasers and light emitting diodes (LEDs).

Electronic devices typically have heat sinks that pass air over a heat dissipation surface directly coupled to the heat generation source. The heat dissipation area is designed to increase heat transfer away from the heat generating core, thereby cooling the electrical device. Heat transfer occurs mainly by way of convection. In computer chips, a highly conductive material having an associated fan is typically mounted directly to the processor. The fan forces air over the conductive material to increase the rate of convection. Without the fan, convection would otherwise occur naturally because hotter air near the source would rise relative to denser, cooler air. For example, as a processor heats the surrounding air, the warmer and less-dense air rises away from the processor and is replaced by the denser, cooler air. In fact, the warmer air will continue to move away from the heat source until it reaches the ambient air temperature of the surrounding environment. The process continues as cooler air continually replaces upwardly rising warmer air.

Fans force convection by blowing air across a heated surface. This naturally results in increased cooling as cooler air forcefully enters the heated space and warmer air is forced out. Natural convection forces may still be present, but they are typically negligible. Forced convection may remove more heat than natural convection, but forced convection carries several drawbacks. For instance, forced convection requires a device, such as a fan, to move the air. In small electronic packages or where it is desirable to minimize the amount of energy expended to cool the electronic components, forced convection may be undesirable. Moreover, reliance on the fans can be detrimental to the operation of the device should the fan become nonoperational. In some circumstances replacing a nonfunctioning fan could be a maintenance problem. Thus, to save time, energy and labor costs required to operate and maintain such devices, it is generally desirable to eliminate the fan from the heat sink, if possible.

For lighting applications, light emitting diodes (LEDs) are particularly energy efficient and tend to have a long operating life. LEDs may be employed in many different basic lighting structures to replace conventional neon or fluorescent lighting. More specifically, LED lighting assemblies may be deployed as street lights, automotive headlights or taillights, traffic and/or railroad signals, advertising signs, etc. These assemblies are typically exposed to natural environmental conditions and may be exposed to high ambient operating temperatures—especially during the daytime, in warmer climates and in the summer. When coupled with the self-generated heat of the LEDs in the assembly, the resulting temperature within the assembly may affect LED performance. In fact, LED performance tends to substantially degrade at higher operating temperatures because LEDs have a negative temperature coefficient of light emission. That is, LED illumination decreases as the ambient temperature rises. For example, LED light intensity is halved at an ambient temperature of 80° Celsius ("C") compared to 25° C. This naturally shortens the lifespan of the LED and reduces light output. These adverse operating conditions can have safety implications depending on the application. Thus, the LED temperature should be kept low to maintain high illumination efficiency.

Heat sink design considerations, therefore, have become increasingly important as LEDs are used in more powerful lighting assemblies that produce more heat energy. Heat dissipated in conventional LED assemblies has reached a critical level such that more intricate heat dissipation designs are needed to better regulate the self-generated heat within the LED assembly. The increased heat within the assemblies is mainly caused by substantially increasing the device drive current to achieve higher luminous output from the LEDs. Preferably, the internal temperature of the lamp assembly is maintained somewhat below the maximum operating temperature so the electrical components therein maintain peak performance. It is advantageous to design an assembly with a mechanism that continually cools the chamber and the LEDs located therein. Accordingly, there is a constant need for improved thermal management solutions for LED-based lighting systems.

There exists, therefore, a significant need for an improved heat sink system that improves the efficiency of dissipating heat away from a heat generating device. Such an improved heat sink system would preferably include a conductive mount that selectively attaches to a heat generation device, and a plurality of cooling fins exposed to air flow. Such an improved heat sink system may include one or more vents to improve air convection cooling and improve heat dissipation away from the heat generation device. Moreover, there is a need for a sturdy, convenient mounting system for such an improved heat sink. The present invention fulfills these needs and provides further related advantages.

SUMMARY OF THE INVENTION

The present invention is directed to a system for mounting an industrial light to a fixed surface. The mounting system generally includes a plurality of spring-loaded pins extending from one of either the industrial light, and a mounting bracket associated with the other of either the industrial light or the fixed surface. The mounting bracket comprises an engagement aperture corresponding to each of the plurality of spring-loaded pins, a retainment aperture associated with each engagement aperture, and an inclined channel connecting each engagement aperture with its associated retainment aperture. A head of each of the spring-loaded pins is inserted through a corresponding one of the engagement apertures and then moved through the associated inclined channel until it is seated within the associated retainment aperture. This structure removably attaches the industrial light to the mounting bracket.

In preferred forms of the invention, the mounting bracket forms a pocket around each retainment aperture in which a head of the corresponding spring-loaded pin is positioned when the industrial light is attached to the mounting bracket.

Each spring-loaded pin includes a pin having a first end fixed to the industrial light and a second end forming an enlarged head, a washer slidable along at least a portion of the pin, and a spring disposed about the pin between the industrial light and the washer. The enlarged head of each pin is smaller in diameter than the corresponding engagement aperture, yet larger in diameter than the corresponding retainment aperture. The washer, on the other hand, of each spring-loaded pin is larger in diameter than the corresponding engagement aperture and retainment aperture.

In several illustrated embodiments, the inclined channel is curvilinear. In another illustrated embodiment, the inclined channel is linear.

The industrial light may include a conductive mount configured to selectively receive and retain a lighting subassembly. In a preferred embodiment, a plurality of LEDs electrically couple to a printed circuit board (PCB) attachable to the conductive mount as part of the lighting subassembly. Each LED is a high brightness LED chip surface mounted to the PCB. An inner heat sink is coupled to the conductive mount and positioned to encompass the lighting assembly. A cap may couple to the inner heat sink to environmentally encapsulate the lighting assembly. Preferably, the cap is a reflector that has a light dispersing lens with an optical diffuser surface area providing no-glare uniform lighting.

The industrial light may further include a plurality of cooling fins coupled to and extending away from the inner heat sink. An outer heat sink coupled to the cooling fins, which may be offset from the inner heat sink, permits air flow therebetween and over the cooling fins. This allows cooling of the inner heat sink, the outer heat sink and the cooling fins via air convection, which effectively draws heat energy away from the lighting assembly to cool the LEDs and the PCB. In turn, the LEDs last longer and are more luminous.

In one embodiment, the outer heat sink is formed from two components: a lower heat sink coupled to a first set of cooling fins mounted to the inner heat sink, and an upper heat sink coupled to a second set of cooling fins offset from the first set of cooling fins. An air vent may extend through the outer heat sink to permit air flow adjacent to the cooling fins and the inner heat sink. This provides enhanced ventilation between the inner heat sink and the outer heat sink. Preferably, the conductive mount, the inner heat sink and the outer heat sink are made from a highly conductive alloy metal or die-cast material designed to dissipate heat energy. The surface area of the outer heat sink is relatively larger than the surface area of the inner heat sink due to the offset nature of the outer heat sink relative to the inner heat sink.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
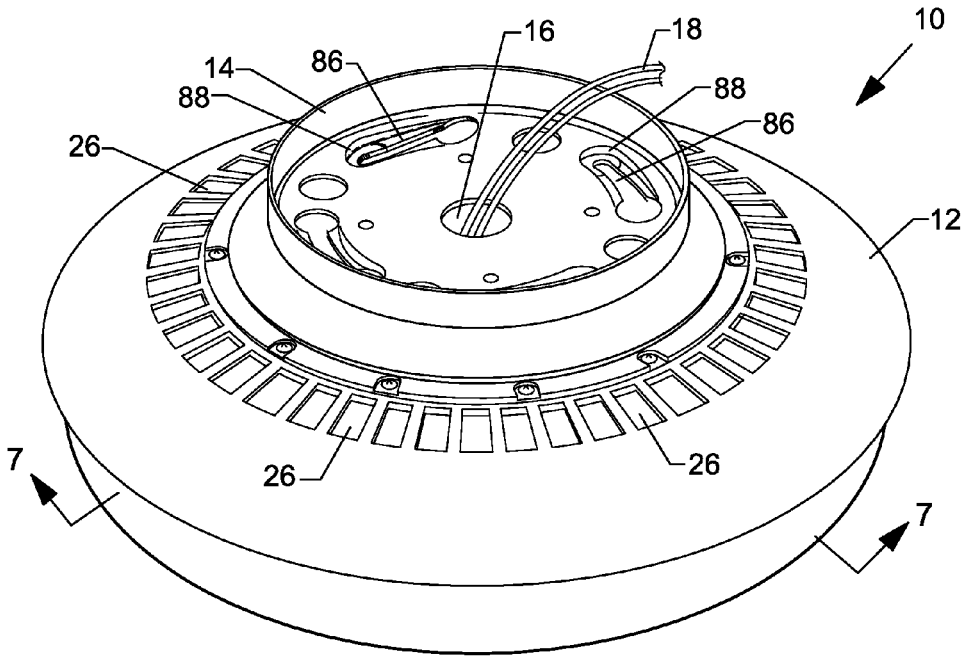
FIG. 1 is a top and side perspective view of an industrial light embodying an improved heat sink system.

As shown in the drawings for purposes of illustration, the present invention for an improved heat sink system is illustrated embodied in an industrial light, referred to generally by the reference number 10. In FIG. 1, the industrial light 10 is illustrated having an outer heat sink 12 coupled to a mounting bracket 14 through a snap and turn mounting system. The mounting bracket 14 includes a central aperture 16 providing access to the interior of the industrial light 10. As shown in FIG. 1, a pair of electrical wires 18 extend out from within the outer heat sink 12 and the mounting bracket 14 to provide electrical energy to a device located within the interior of the outer heat sink 12. Positioning the central aperture 16 to the interior of the mounting bracket 14 ensures that the industrial light 10 can be attached to the mounting bracket 14 via the aforementioned snap and turn mounting system without the electrical wires 18 binding, twisting or otherwise getting caught on components inside the outer heat sink 12 or the bracket 14. This feature is particularly ideal because the industrial light 10 can be engaged or disengaged from the mounting bracket 14 with ease. The features of the snap and turn mechanism are described in more detail below with respect to FIGS. 9-11.

Figure 2:
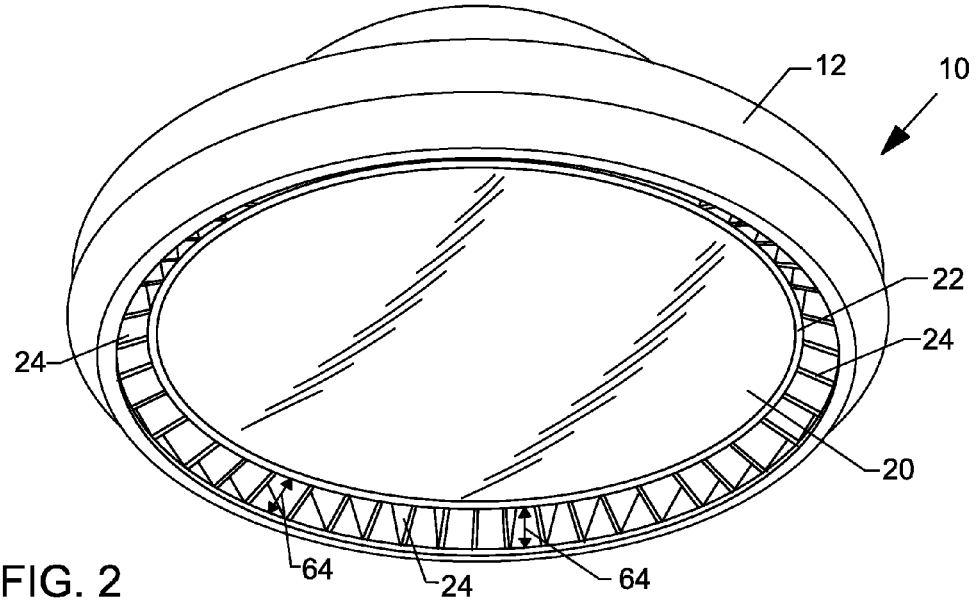
FIG. 2 is a bottom and side perspective view of the industrial light of FIG. 1.

FIG. 2 illustrates a bottom perspective view the industrial light 10. The industrial light 10 includes a light diffuser 20 coupled to an inner heat sink 22 to form an environmentally sealed chamber therein. FIG. 2 further illustrates a plurality of cooling fins 24 extending between the inner heat sink 22 and the outer heat sink 12. Preferably, the outer heat sink 12 is offset from the inner heat sink 22 by the width of the cooling fins 24 to maximize the amount of surface area of the inner heat sink 22, the outer heat sink 12 and the cooling fins 24 subject to air convection cooling. The area between the inner heat sink 22 and the outer heat sink 12 is primarily open to the environment to allow air flow therethrough. As shown in FIG. 1, the outer heat sink 12 includes a plurality of vents 26 that facilitate such air flow through the outer heat sink 12 and adjacent to the inner heat sink 22 and the cooling fins 24. These particular features, as illustrated in more detail below, enable the industrial light 10 to encapsulate and environmentally seal (e.g. water proof) utilizing O-rings between appropriate components, the heat generating device therein while maximizing exposure of the respective surface areas of the inner heat sink 22, the cooling fins 24 and the outer heat sink 12 to facilitate air convection cooling.

Figure 3:
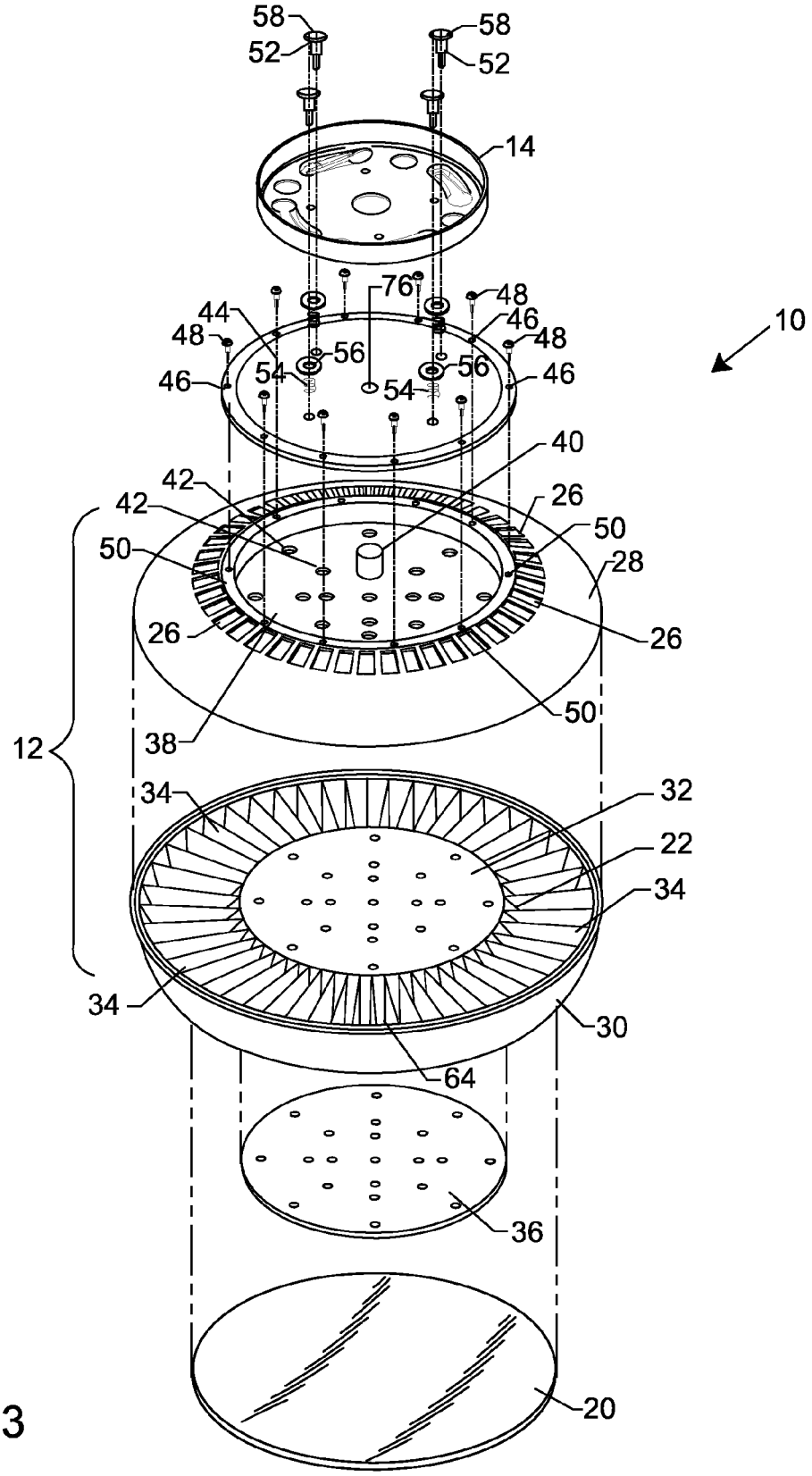
FIG. 3 is an exploded perspective view of the industrial light of FIGS. 1 and 2.

FIG. 3 is an exploded perspective view of the industrial light 10. The outer heat sink 12 is illustrated split into an upper heat sink 28 and a lower heat sink 30. The lower heat sink 30 has a conductive mount 32 positioned central to a plurality of lower cooling fins 34 biased between the inner heat sink 22 and the lower heat sink 30. Preferably, the conductive mount 32 conductively couples to the lower cooling fins 34 via the inner heat sink 22. A heat generating device 36, in this case a PCB 36 having a plurality of high brightness LED chips surface mounted therein, attaches to the conductive mount 32 by any means known in the art. For example, the PCB 36 may be soldered to the conductive mount 32 by a highly conductive metal material such as tin. Alternatively, the PCB 36 may mechanically attach to the conductive mount 32 by clips, snaps or another attachment mechanism known in the art. In this embodiment, it may be preferable to dispose a conductive material between the planar portion of the conductive mount 32 and the PCB 36 to increase the efficiency of heat transfer between the two components. One particularly preferred material may include the thermal compounds commonly used between computer chips and their heat sinks. One particularly preferred feature of the industrial light 10 is that the planar portion of the PCB 36 abuts the planar portion of the conductive mount 32 thereby increasing the surface area contact therebetween. The light diffuser 20 extends up into and attaches to the lower heat sink 30 to encapsulate the PCB 36 within the interior of the industrial light 10, as described in more detail below with respect to FIG. 6.

The upper heat sink 28 includes a chamber 38 that houses various electrical components, including a power supply 40. The power supply 40 is preferably an integrated high efficiency LED driver power supply. Such a power supply 40 has a power factor (PFC)>0.94 and has 90% efficiency. A smart circuitry (not numbered) integral to the power supply 40 preferably includes 6000 VAC surge and transient voltage protection to prevent the electrical components from being damaged in the event of an electrical spike. The current should be precisely controlled to make sure it stays constant so that the power source 40 remains stable. The chamber 38 provides space for electrical components such as the power supply 40, circuits and other similar devices that operate the industrial light 10. The chamber 38 also provides room to wire these devices to the power supply 40 for operating the industrial light 10. Threaded apertures 42 are provided through the upper heat sink 28 to facilitate attachment of the PCB 36 to the conductive mount 32. In particular, threaded screws 66 (shown in FIGS. 7 and 8) are utilized to tighten the PCB 36 to the conductive mount 32 as they are threaded through the apertures 42 of the upper heat sink 28. Preferably, nothing protrudes from the back of the PCB 36 so that is has maximum contact with the conductive mount 32 for transfer of heat. The chamber 38 is preferably environmentally sealed, such as by a cap 44. In the embodiment shown in FIG. 3, the cap 44 includes a plurality of apertures 46 around its exterior circumference that each selectively receives a screw 48. A plurality of threaded recesses 50 are disposed around the internal circumference of the upper heat sink 28 between the chamber 38 and the vents 26. The screws 48 extend through the respective apertures 46 to engage the threaded recesses 50 to securely attach the cap 44 to the upper heat sink 28. An O-ring (not shown), sealant or other adhesive may be disposed between the cap 44 and the upper heat sink 28 to ensure that the chamber 38 is sealed from the exterior environment.

Moreover, the cap 44 further includes a plurality of pins 52 threadingly engaged thereto. A set of respective springs 54 bias a washer 56 toward a head portion 58 of the pins 52. The pins 52, the springs 54 and the washers 56 cooperate with one another to selectively engage the mounting bracket 14. This enables a user to selectively engage the cap 44 with the mounting bracket 14 by utilizing the snap and turn mounting mechanism described below with respect to FIGS. 9-11.

Figure 4:
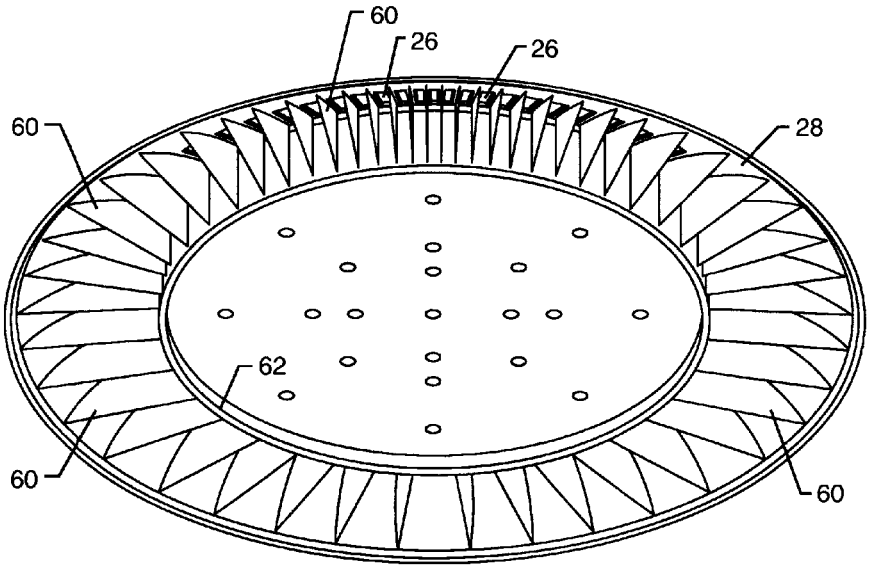
FIG. 4 is a bottom perspective view of an upper heat sink component of the industrial light of FIGS. 1-3.
Figure 5:
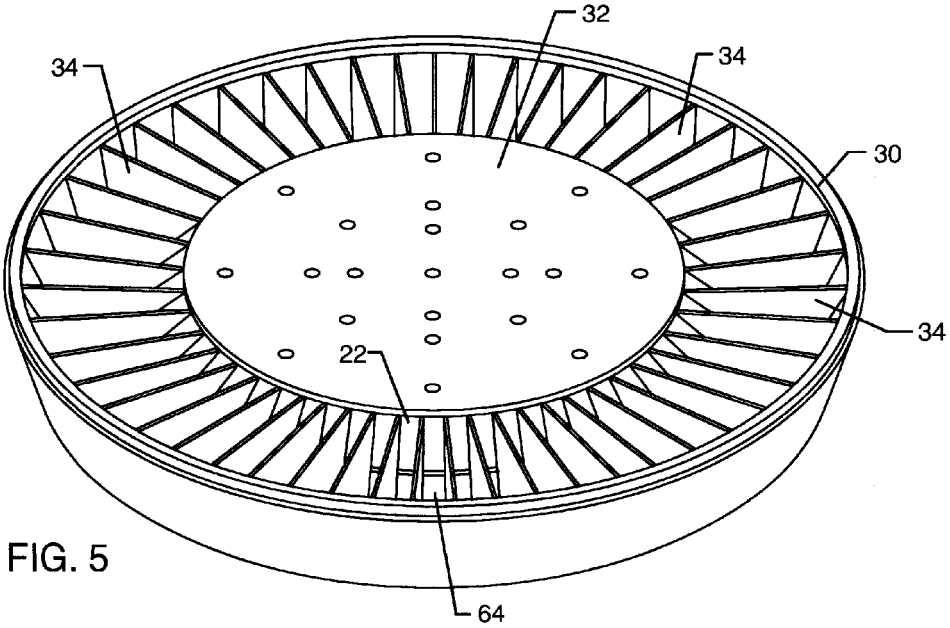
FIG. 5 is a top perspective view of a lower heat sink component of the industrial light of FIGS. 1-3.

FIGS. 4 and 5 illustrate the interior of the upper heat sink 28 and the lower heat sink 30, respectively. Preferably, the upper heat sink 28 engages the lower heat sink 30 through some mechanical or adhesive connection mechanism that ensures that the two heat sinks 28, 30 remain environmentally sealed to one another. Preferably, the operation of attaching the PCB 36 to the conductive mount 32 by threading screws through the threaded apertures 42 of the upper heat sink 28, assembles all three components (the PCB 36, the lower heat sink 30 and the upper heat sink 28) in one operation. Hermetic sealing is obtained between the upper and lower heat sinks by having an O-ring (not shown) disposed in a semi-circular groove on the inner heat sink 22 of the lower heat sink 30.

Figure 7:
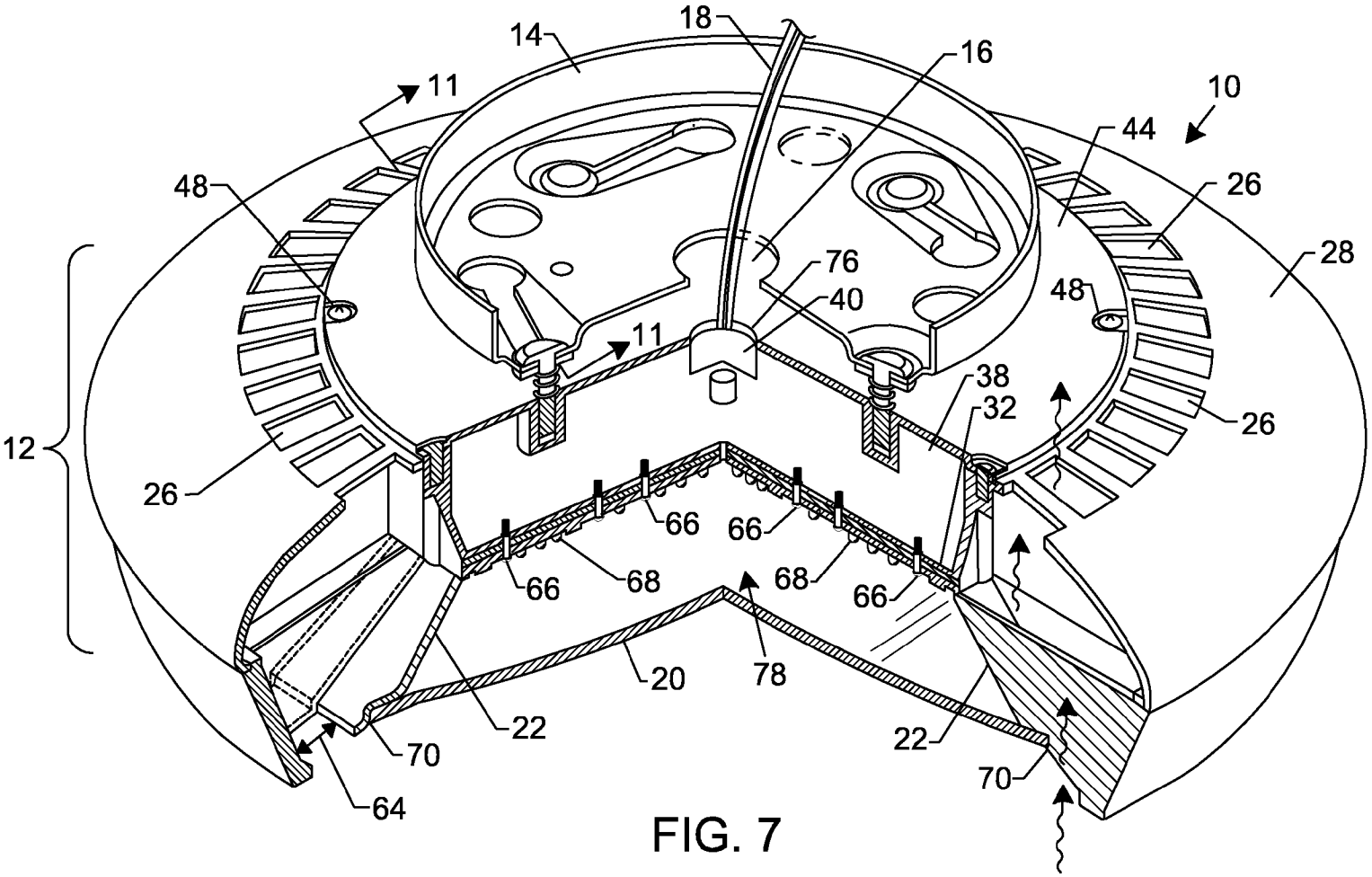
FIG. 7 is a partial cut-away perspective view taken along the line 7-7 in FIG. 1, illustrating the assembled components of the industrial light including a snap and turn mounting system, as illustrated in FIG. 3.

One particular aspect of the upper heat sink 28 and the lower heat sink 30 shown in FIGS. 4 and 5 is that each heat sink 28, 30 includes its own set of cooling fins 24—i.e. the upper heat sink 28 includes a plurality of upper cooling fins 60 while the lower heat sink 30 includes its own set of lower cooling fins 34. With respect to FIG. 4, the upper heat sink 28 includes an inner vertical ring 62 that, in part, forms the aforementioned chamber 38 between the conductive mount 32 and the generally arcuate outer surface of the upper heat sink 28. The upper cooling fins 60 extend from this vertically extending inner ring 62 to the exterior circumference of the upper heat sink 28. The outer exterior surface of the upper heat sink 28 is curved as shown in FIGS. 1, 3 and 7. Thus, the upper cooling fins 60 tend to follow the curvature of the outer surface of the upper heat sink 28. Even though the upper heat sink 28 and the matching lower heat sink 30 are circular and generally arcuate, a person of ordinary skill in the art will readily recognize that the heat sinks 28, 30 could be made out of any shape, size or configuration. The purpose of positioning the upper cooling fins 60 between the inner ring 62 and the outer surface area of the upper heat sink 28 is to maximize the surface area therein. These features enhance the heat dissipation efficiency of the improved heat sink system of the industrial light 10 described herein. Each of the upper cooling fins 60 are preferably positioned intermediate to the vents 26 to ensure efficient air flow through the outer heat sink 12 and across the surface area of all the aforementioned cooling fins 24.

The lower heat sink 30 is configured similarly to the upper heat sink 28. In this regard, the plurality of lower cooling fins 34 extend between the inner heat sink 22 and the lower heat sink 30. The inner heat sink 22 is conductively coupled to the conductive mount 32 and extends outwardly therefrom at an angle as shown in FIGS. 5 and 7. One feature of the improved heat sink system described herein is that the inner heat sink 22 only extends partially between the conductive mount 32 and the exterior of the lower heat sink 30. As shown in more detail with respect to FIG. 6, this enables the light diffuser 20 to secure up into and abut the outer portion of the inner heat sink 22 to encapsulate the PCB 36 within the interior of the industrial light 10. This ensures that the LEDs and related circuitry are not exposed to the external environment. Isolating the internal circuitry allows the body/housing of the industrial light 10—i.e. the improved heat sink system—to operate as the heat sink itself. Furthermore, this ensures that the heat dissipation properties of the improved heat sink are not sacrificed. FIG. 2 more specifically illustrates the termination of the inner heat sink 22 along the exterior circumference of the light diffuser 20. The diameter of the light diffuser 20 and the inner heat sink 22 is smaller than the diameter of the lower heat sink 30. Thus, a gap 64 exists between the inner heat sink 22 and the lower heat sink 30. As best shown in FIG. 7, the gaps 64 permit air to flow over the lower heat sink 22, the lower cooling fins 34 and up through the upper heat sink 28 and the upper cooling fins 60. Air is allowed to exit through the top of the industrial light 10 through the vents 26. Placing the plurality of cooling fins 24 three hundred sixty degrees around the exterior of the heat generating device 36 increases the available heat dissipating surface area subject to air flow therethrough via the vents 26 in the upper heat sink 28 and the gaps 64 in the lower heat sink 30. This maximizes the air convection on an increased surface area around the heat generating device 36. External radiator light ribs are no longer needed. Thus, the potential for the industrial light 10 to collect dust and dirt that reduces/chokes air convection and cooling in traditional systems is greatly reduced.

Figure 6:
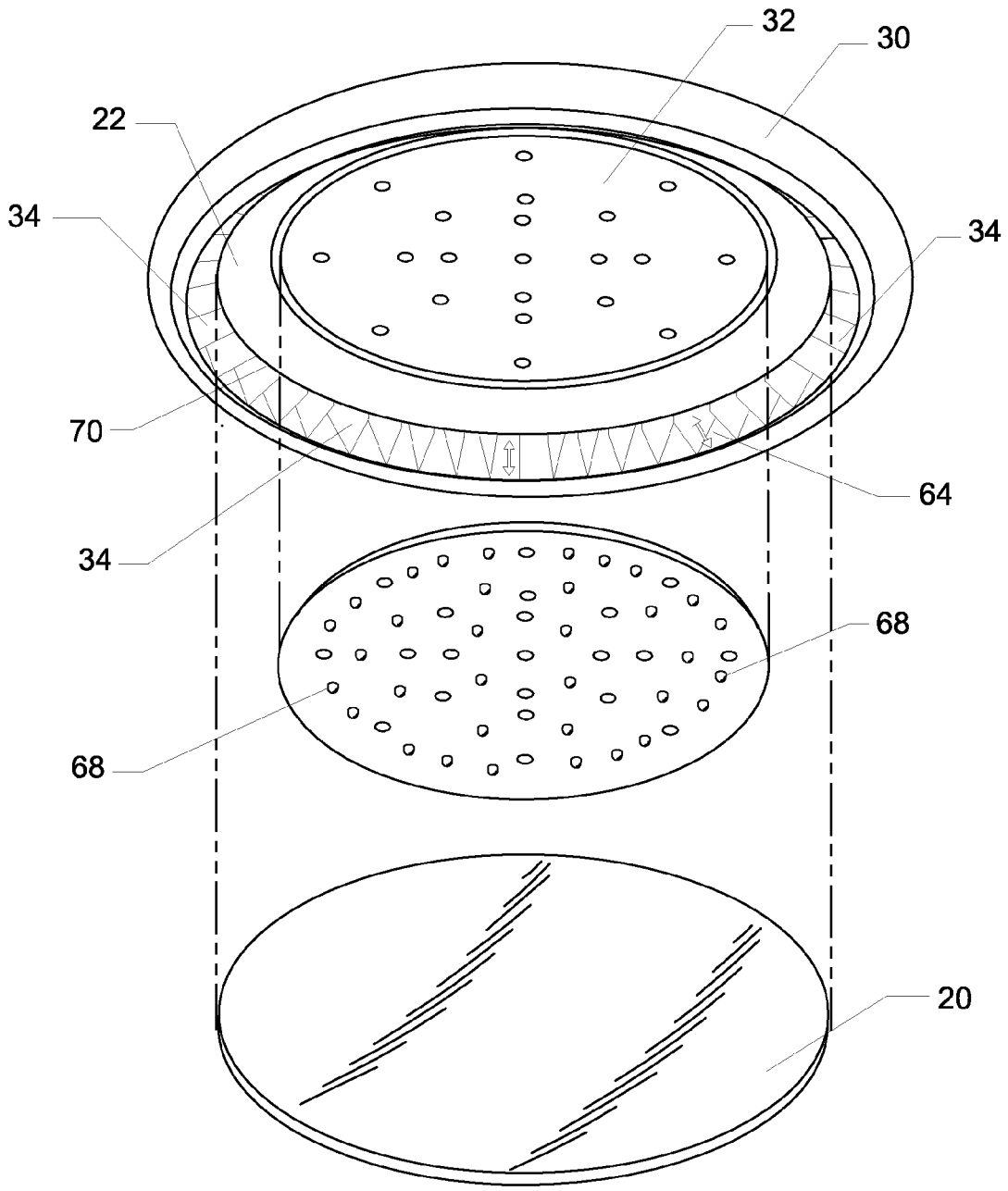
FIG. 6 is an exploded perspective view illustrating attachment of a PCB having a plurality of LEDs therein to the lower heat sink component of FIG. 5.

FIG. 6 is an exploded perspective view that illustrates how the PCB 36 and the attached surface mount LEDs 68 are encapsulated within the interior of the lower heat sink 30 by the light diffuser 20 and the inner heat sink 22. The planar surface of the PCB 36 is placed adjacent to and abuts the conductive mount 32. Heat generated by the LEDs 68 immediately conducts back into the conductive mount 32. Such conduction draws heat away from the heat generating device, in this case the PCB 36, to ensure the longevity of the LEDs 68. The inner heat sink 22 extends outwardly from the conductive mount 32 and terminates at an outer edge 70. The inner heat sink 22 is positioned to encompass the PCB 36 such that its surface area is subject to outwardly expanding heat generated by the PCB 36 and the LED 68. This heat is transferred to the inner heat sink 22 and the lower cooling fins 34. Each of the lower cooling fins 34 follows the contour of the inner heat sink 22 to the termination edge 70. From there, the lower cooling fins 34 extend out to the interior of the lower heat sink 30, thereby forming the gaps 64 between the outer edge 70 of the inner heat sink 22 and the exterior of the lower heat sink 30. Air is allowed to flow through the gaps 64 and adjacent to the lower cooling fins 34 and the inner heat sink 22 while the LEDs 68 surface mounted to the PCB 36 remain sealed from the environment. The circumferential gaps 64 act as air vents that allow air convection cooling of the various surface areas thereof to create a better heat dissipation system. The key is that heat is always drawn away from the heat generating device 36. Lower temperatures at the PCB 36 generally increase the life and output of the LEDs 68.

FIG. 7 is a partial cut-away of the industrial light 10 as described herein. FIG. 7 illustrates the generally arcuate upper heat sink 28 attached to the cap 44 by the screws 48. Connection of the cap 44 to the upper heat sink 28 forms the chamber 38 therebetween. The chamber 38 houses various electrical components, including electrical connectors for each of the LEDs 68 that couple the LEDs 68 to the power supply 40 and other electronic equipment, such as a safety controlled smart circuitry. Such circuitry includes an over temperature production sensor, an over voltage protection sensor and an over current protection sensor. Each of these sensors are coupled to a kill switch that shuts off or reduces power output from the power supply 40 to the LEDs 68 in the event that the temperature protection sensor determines a threshold temperature has been exceeded, the voltage protection sensor determines that a voltage threshold has been exceeded, or the current protection sensor determines that a current threshold has been exceeded. The electrical wires 18 extend out from the power supply 40, through a central aperture 76 in the cap 44 and out through the central aperture 16 in the mounting bracket 14. The central apertures 16, 76 allow the industrial light 10 to rotate relative to the mounting bracket 14 without any of the electrical wires 18 or the electrical connectors from twisting, binding or otherwise catching on any of the components described herein.

FIG. 7 also illustrates the connection of the inner heat sink 22 to the conductive mount 32 and to the light diffuser 20 along the edge 70. The inner heat sink 22 generally extends out and away from the conductive mount 32 at the angle shown. The light diffuser 20 connects to the inner heat sink 22 along the outer edge 70 thereof. Light generated by the LEDs 68 enters the interior of the industrial light 10 formed by the conductive mount 32, the inner heat sink 22 and the light diffuser 20. The interior surface area of the light diffuser 20, the inner heat sink 22 and the conductive mount 32 (which is partially obstructed by the PCB 36 attached thereto) forms an enclosure 78 environmentally sealed to protect the integrity of the LEDs 68 from weather conditions or other environmental factors that may decrease the life span of the LEDs 68. At the same time, air is allowed to flow between the outside surface area of the inner heat sink 22 and the interior surface area of the outer heat sink 12. Exemplary air flow is designated by the directional arrows shown in FIG. 7. Specifically, air flow may enter between the inner heat sink 22 and the outer heat sink 12 through the gaps 64. Air flow then passes adjacent to the interior surface area of both the lower and upper heat sinks 28, 30, past the cooling fins 24 and out through the vents 26 in the upper heat sink 28. The air flow sequence may also be reversed depending on deployment of the improved heat sink system and/or the industrial light 10 described herein. Either way, the important aspect is that air flow is able to move through a larger surface area through deployment of the outer heat sink 12 coupled to the inner heat sink 22 via the plurality of cooling fins 24. Additionally, this design provides such enhanced air flow and heat dissipation while simultaneously encapsulating the heat generating device 36 (in this case the PCB 36) from adverse environmental conditions that may shorten the life of the device 36, including, for example, the LEDs 68. Thus, cooling by air convection takes place at a higher rate compared to traditional heat sinks. This occurs because other traditional heat sinks have similar ribs/membranes without the outer heat sink 12 and the vents 26, which eliminates any air flow therebetween and decreases available surface area, thereby significantly reducing air convection.

Figure 8:
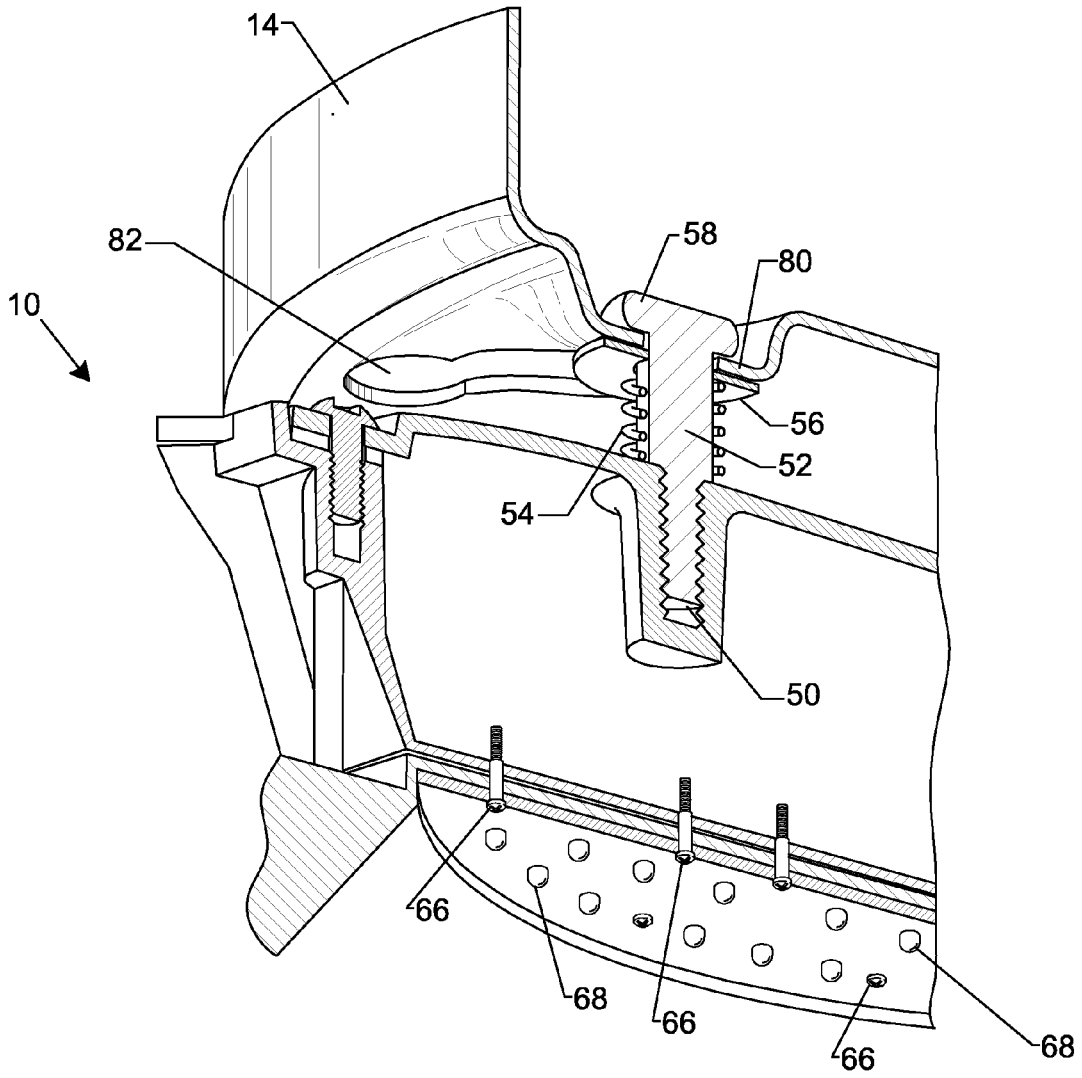
FIG. 8 is an enlarged fragmented perspective view of the PCB attached to a conductive mount and an associated snap and turn mounting system.

A portion of the snap and turn mounting system is shown generally in FIG. 8. First, the mounting bracket 14 is screwed into a ceiling or attached to another component that will retain the industrial light 10. In general, FIG. 8 is an enlarged cut out view illustrating the pin 52 engaged to the cap 44 via the threaded recess 50. The pin 52 is shown secured to the mounting bracket 14. The coil spring 54 biases the washer 56 against a flange 80 of the mounting bracket 14 engaged on the other end by the head 58 of the pin 52.

Figure 9:
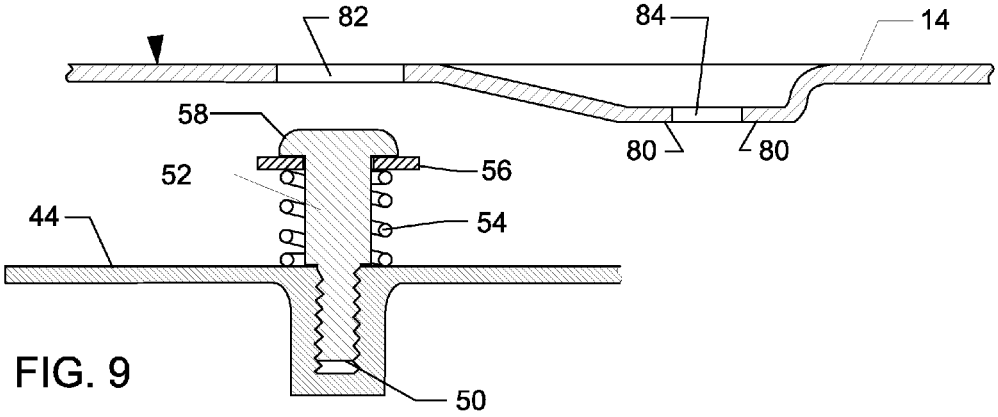
FIG. 9 is a partial cross-sectional view based on the section 11-11 in FIG. 7, illustrating a mounting pin extending from the industrial light and positioned to engage a mounting bracket.
Figure 10:
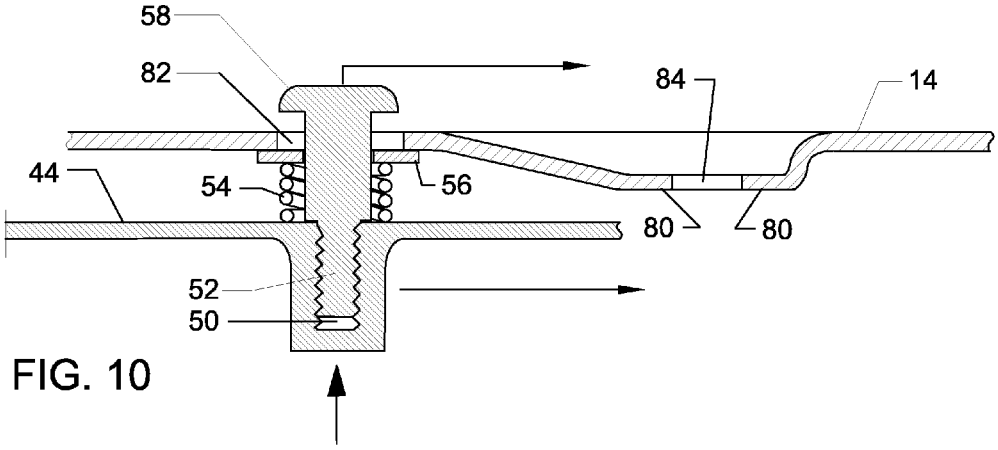
FIG. 10 is a partial cross-sectional view similar to FIG. 9, illustrating the mounting pin extending through the mounting bracket and biased therein by a spring tensioned washer.
Figure 11:
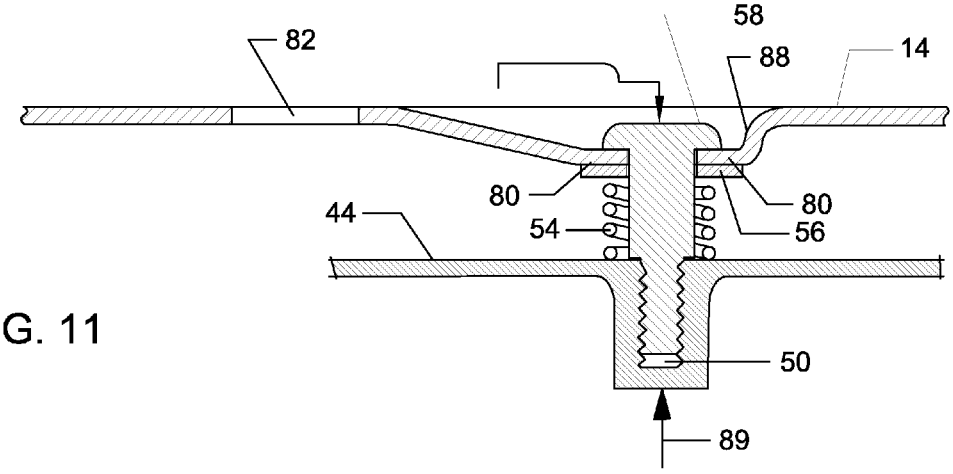
FIG. 11 is a partial cross-sectional view similar to FIGS. 9 and 10, illustrating engagement of the pin with the mounting bracket and biased therebetween with the spring tensioned washer.

FIG. 9 more specifically illustrates the pin 52 mounted to the threaded aperture 50 of the cap 44. Here, the mounting bracket 14 has been pre-attached to a surface or an object to which the industrial light 10 is to be used. As shown in FIG. 9, the spring 54 biases the washer 56 underneath the head 58 of the pin 52 with minimal pressure. The spring 54 applies constant pressure to the washer 56 such that the washer 56 remains flush against the head 58 of the pin 52 when the industrial light 10 is disengaged from the mounting bracket 14. The head 58 is sized to fit through an engagement aperture 82 (also shown in FIG. 8) in the mounting bracket 14. To do so, the user pushes the industrial light 10 up into the mounting bracket 14 as best shown in FIG. 10. The outer diameter of the head 58 fits through the engagement aperture 82 of the mounting bracket 14, but the outer diameter of the washer 56 is wider than the engagement aperture 82 and catches on the surface thereof. The washer 56 moves longitudinally along the length of the pin 52 compressing the coil spring 54 as shown in FIG. 10 relative to FIG. 9. This enables a user to effectively push the head 58 through the mounting bracket 14 for eventual engagement in a retainment aperture 84. Once the head 58 extends through the width of the mounting bracket 14, a user may twist or turn the industrial light 10 in a circular or linear pattern such that the body of the pin 52 engages the respective snap and turn channels 86 best shown in FIG. 1. The channels 86 are sized to facilitate the width of the body of the pin 52 while being smaller than the diameter of the head 58 and the washers 56. Continuing to rotate the industrial light 10 eventually causes the pin 52 to enter within a pocket 88 formed into the surface of the mounting bracket 14. The retainment aperture 84 within the pocket 88 has a diameter that is approximately the diameter of the width of the pin head 58. Thus, the larger width head 58 engages the flanges 80 which define the retainment aperture 84 as shown in FIG. 11. Once the user releases the industrial light 10, the coil spring 54 extends upwardly to engage the washer 56 underneath the flanges 80. Accordingly, the head 58 and the washer 56 sandwich the flanges 80 therebetween to secure the pin head 58 in the retainment aperture 84 of the pocket 88. The pocket 88 is recessed from the general planar portion of the mounting bracket 14 to ensure that the locking pin 52 remains securely therein. This prevents the pin 52 from sliding or rotating back out of the retainment aperture 84 from vibration, wind or other similar movements. To remove the industrial light 10, a user need only apply pressure along the arrow 89 shown in FIG. 11 to pop out the head 58 from within the interior of the pocket 88 to enable sliding movement back through the channels 86 such that the head 58 is realigned with the engagement aperture 82 for removal out from within the mounting bracket 14.

Figure 12:
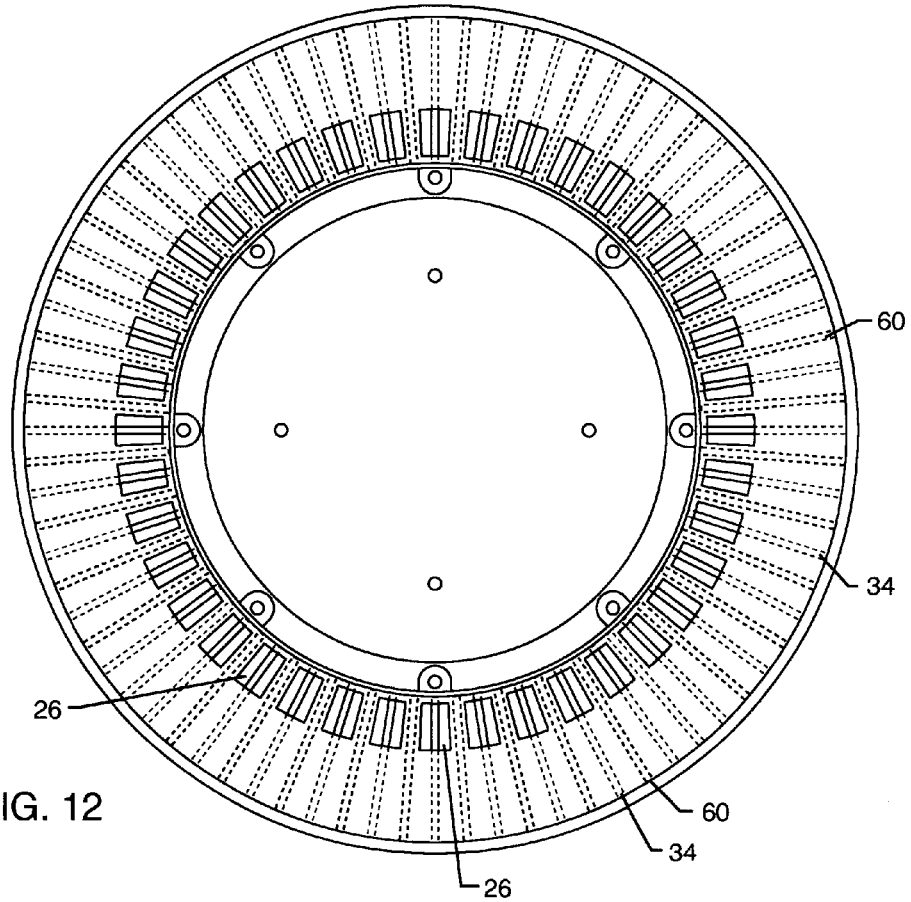
FIG. 12 is a top plan view of the industrial light of FIGS. 1-7 positioning of cooling fins extending between the upper and lower heat sink components.
Figure 13:
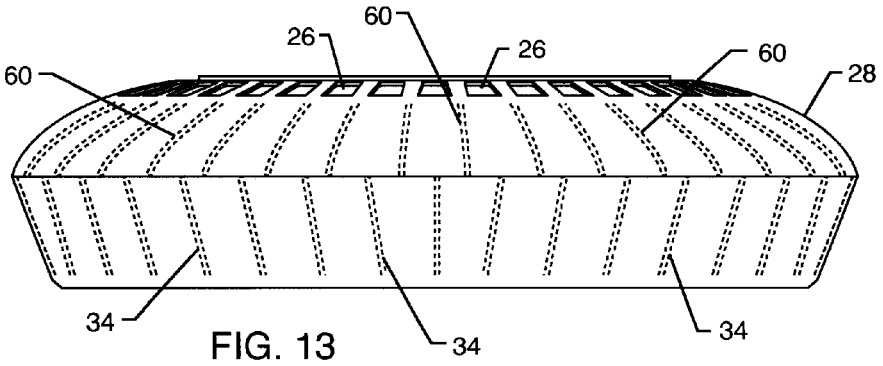
FIG. 13 is a side view of the industrial light of FIG. 12, illustrating offset positioning of the upper and lower cooling fins.

FIGS. 12 and 13 illustrate the arrangement of the upper cooling fins 60 and the lower cooling fins 34. Preferably, the lower cooling fins 34 are offset from the upper cooling fins 60 as generally illustrated in FIG. 13. It is also preferable that the upper cooling fins 60 be offset from the plurality of vents 26 in the upper heat sink 28. As such, the lower cooling fins 34 may be aligned with the vents 26 as shown by the solid lines in FIG. 12. The offsetting nature of the lower cooling fins 34 from the upper cooling fins 60 is designed to enhance the heat dissipating surface area subject to air convection to increase the cooling efficiency of the isolated heat sink system. These features maximize air convection on the effective surface areas around the heat generating device 36 to increase the efficiency of dissipating heat from the source to the external environment. As heat is generated by the PCB 36, it is transferred to the offset lower cooling fins 34 and the upper cooling fins 60 via the conductive mount 32 and the inner heat sink 22. Positioning the cooling fins 34 three hundred sixty degrees around the exterior of the heat generating device 36 further maximizes the heat dissipation qualities of the improved heat sink system.

Figure 14:
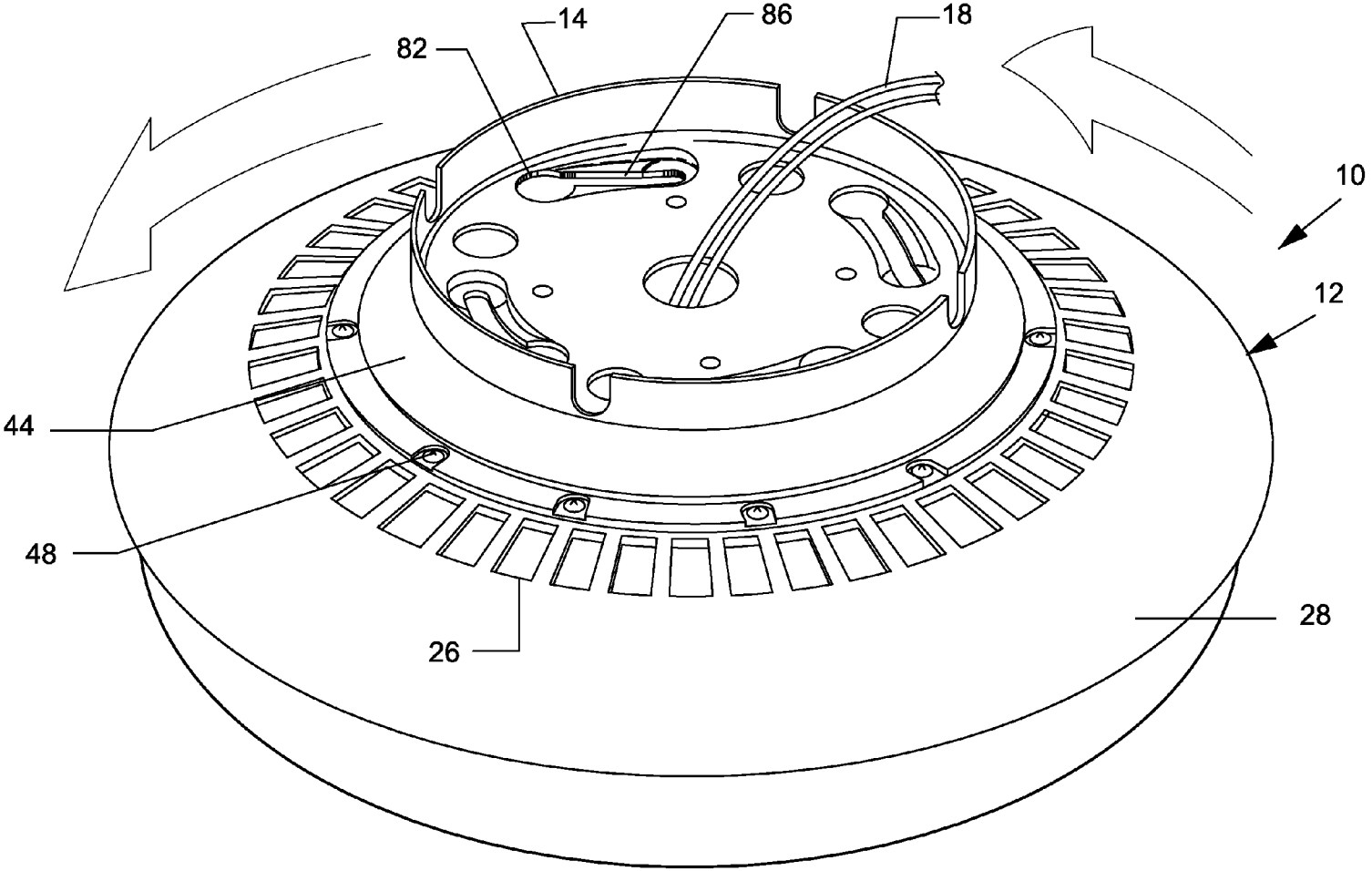
FIG. 14 is a perspective view of a novel snap and turn mounting bracket, illustrating the manner in which the improved heat sink engages the mounting bracket and is secured thereto.
Figure 15:
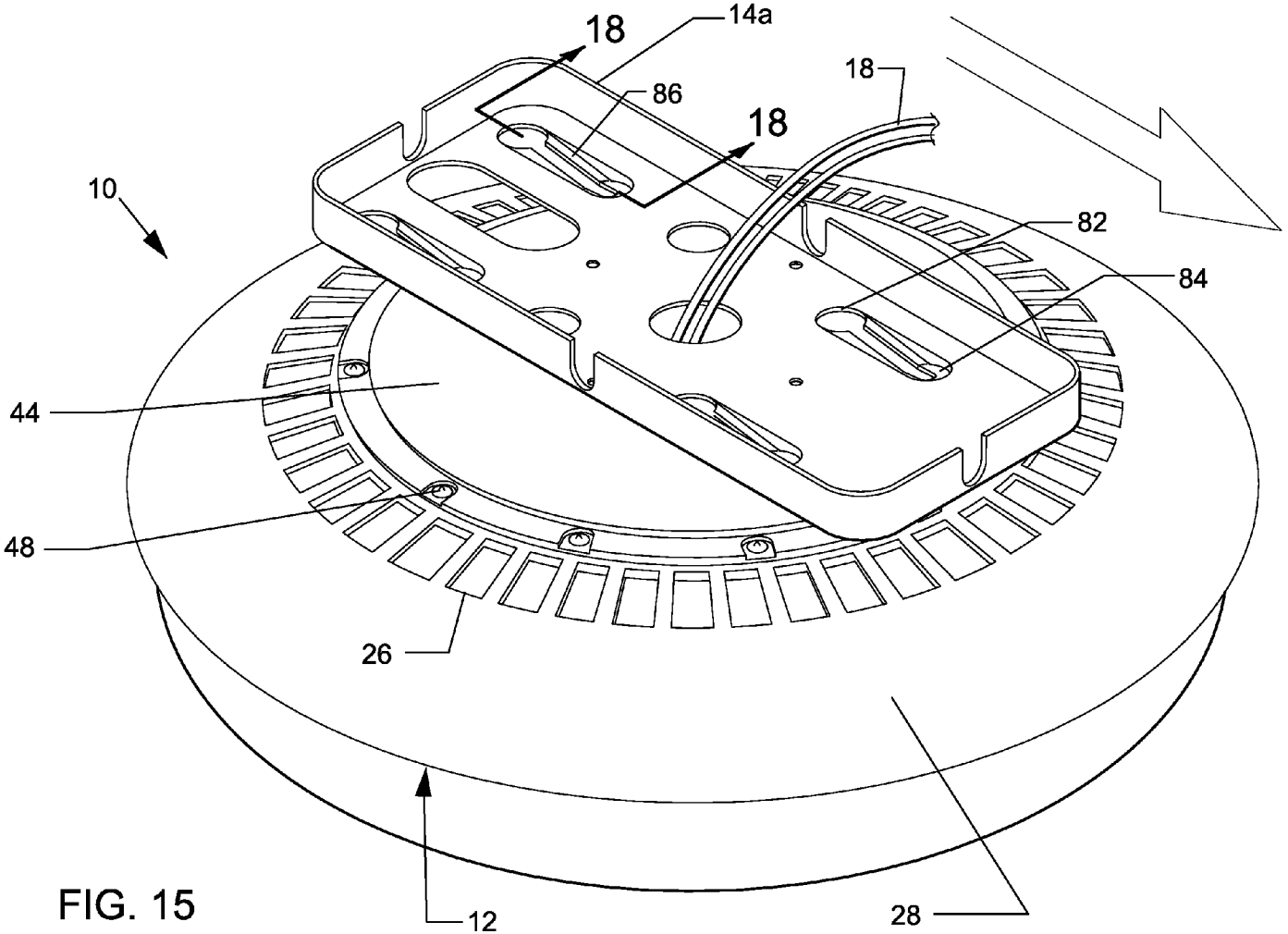
FIG. 15 is a perspective view similar to FIG. 14, illustrating a novel snap and slide mounting bracket utilized to secure the improved heat sink in place.

FIG. 14 illustrates a snap and turn mounting system for the industrial light 10 similar to that illustrated in FIG. 1, and FIG. 15 illustrates a snap and slide mounting system for the industrial light 10. Functionally, both mounting brackets 14 and 14A are similar, and the functional components shall retain the same reference numbers as discussed above in connection with FIG. 1. Notably, the mounting bracket 14 of FIG. 14 includes channels 86 which are curvilinear, whereas the snap and slide mounting bracket 14A shown in FIG. 15 includes channels 86 that are linear.

With reference to both mounting brackets 14 and 14A shown in FIGS. 14 and 15, a central aperture 16 provides access to the interior of the industrial light 10. A pair of electrical wires 18 extend out from within the outer heat sink 12 and the mounting bracket 14, 14A to provide electrical energy to a device located within the interior of the outer heat sink 12. As discussed above, and as shown in FIG. 3, the cap 44 includes a plurality of apertures around its exterior circumference that each selectively receives a screw 48. A plurality of threaded recesses 50 are disposed around the internal circumference of the upper heat sink between the chamber 38 and vents 26. The screws 48 extend through the respective apertures 46 to engage threaded recesses 50 to securely attach the cap to the upper heat sink 28. This cap 44 includes a plurality of pins 52 threadingly engaged thereto. A set of respective springs 54 bias a washer 56 toward a head portion 58 of the pins 52. The pins 52, the springs 54 and the washers 56 cooperate with one another to selectively engage the mounting bracket 14, 14A. This enables a user to selectively engage the cap 44 with the mounting bracket 14, 14A by utilizing the snap and turn or snap and slide mounting mechanism described more fully in connection with FIGS. 16-18.

In use, the mounting bracket 14, 14A is screwed into a ceiling or attached to another component that will retain the industrial light 10. As shown, the pins 52 engage the cap 44 via threaded recesses 50. The coil spring 54 biases the washer 56 against a flange 80 surrounding the retainment aperture of the mounting bracket, which is engaged on the other end by the head 58 of the pin 52.

Figure 16:
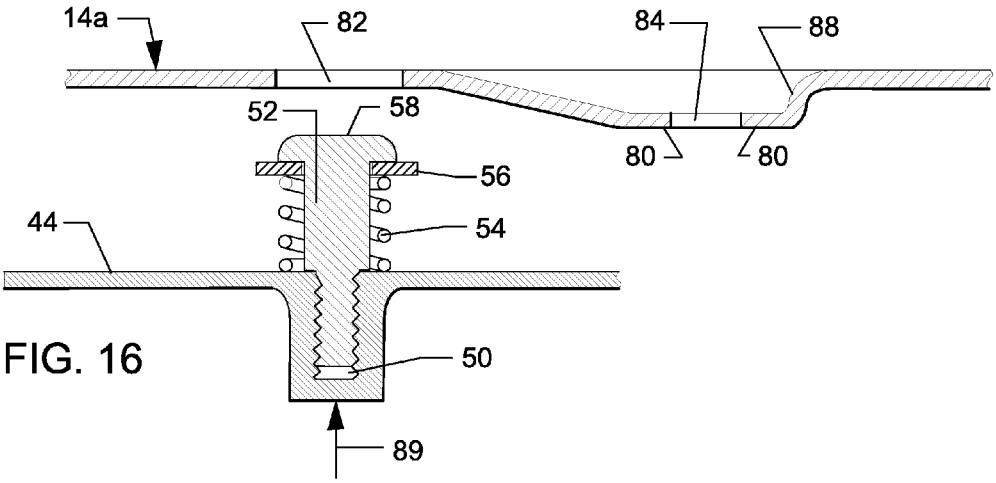
FIG. 16 is an enlarged partial cross-sectional view based on section 18-18 from FIG. 15, illustrating a mounting pin extending from the industrial light and positioned to engage the snap and slide mounting bracket.
Figure 17:
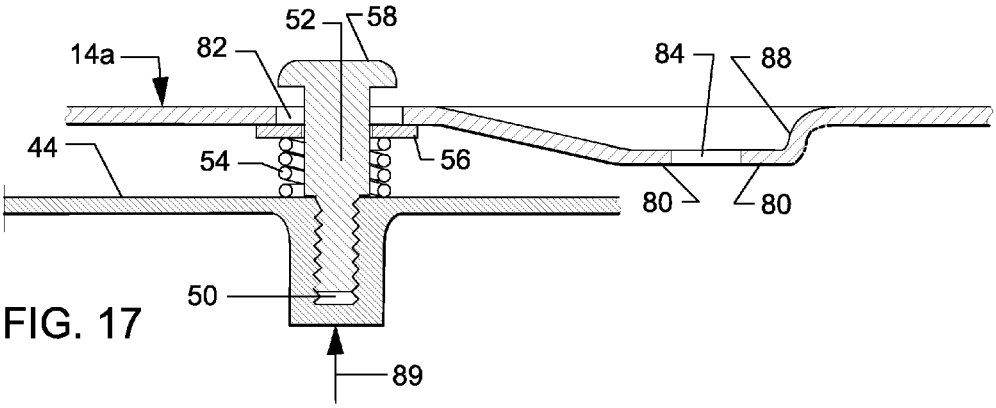
FIG. 17 is a partial cross-sectional view similar to FIG. 16, illustrating the mounting pin extending through the mounting bracket and biased therein by a spring tensioned washer.
Figure 18:
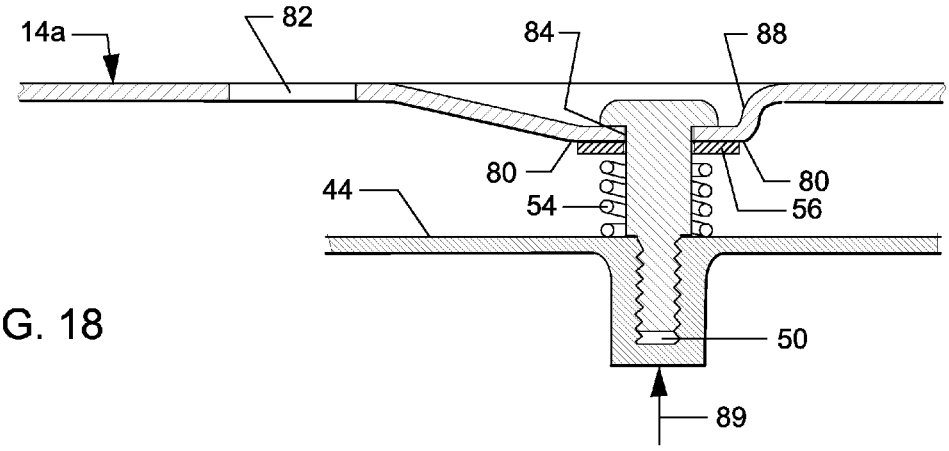
FIG. 18 is a partial cross-sectional view similar to FIGS. 16 and 17, illustrating engagement of the pin with the mounting bracket biased therebetween with the spring tensioned washer.

As illustrated in FIG. 16, the spring 54 biases the washer 56 underneath the head 58 of the pin 52 with minimal pressure. The spring 54 applies constant pressure to the washer 56 such that the washer 56 remains flush against the head 58 of the pin 52 when the industrial light 10 is disengaged from the mounting bracket 14. The head 58 is sized to fit through an engagement aperture 82 (also shown in FIG. 8) in the mounting bracket 14. To do so, the user pushes the industrial light 10 up into the mounting bracket 14 as best shown in FIG. 17. The outer diameter of the head 58 fits through the engagement aperture 82 of the mounting bracket 14, but the outer diameter of the washer 56 is wider than the engagement aperture 82 and catches on the surface thereof. The washer 56 moves longitudinally along the length of the pin 52 compressing the coil spring 54 as shown in FIG. 17 relative to FIG. 16. This enables a user to effectively push the head 58 through the mounting bracket 14 for eventual engagement in a retainment aperture 84. Once the head 58 extends through the width of the mounting bracket 14, a user may twist or turn the industrial light 10 in a circular or linear pattern such that the body of the pin 52 engages the respective snap and turn channels 86 best shown in FIG. 1. The channels 86 are sized to facilitate the width of the body of the pin 52 while being smaller than the diameter of the head 58 and the washers 56. Continuing to rotate the industrial light 10 eventually causes the pin 52 to enter within a pocket 88 formed into the surface of the mounting bracket 14. The retainment aperture 84 within the pocket 88 has a diameter that is approximately the diameter of the width of the pin head 58. Thus, the larger width head 58 engages the flanges 80 which define the retainment aperture 84 as shown in FIG. 18. Once the user releases the industrial light 10, the coil spring 54 extends upwardly to engage the washer 56 underneath the flanges 80. Accordingly, the head 58 and the washer 56 sandwich the flanges 80 therebetween to secure the pin head 58 in the retainment aperture 84 of the pocket 88. The pocket 88 is recessed from the general planar portion of the mounting bracket 14 to ensure that the locking pin 52 remains securely therein. This prevents the pin 52 from sliding or rotating back out of the retainment aperture 84 from vibration, wind or other similar movements. To remove the industrial light 10, a user need only apply pressure along the arrow 89 shown in FIG. 18 to pop out the head 58 from within the interior of the pocket 88 to enable sliding movement back through the channels 86 such that the head 58 is realigned with the engagement aperture 82 for removal out from within the mounting bracket 14.

From the foregoing it will be appreciated that the novel mounting system for an industrial light 10 comprises a plurality of spring-loaded pins 52 extending from the industrial light, and a mounting bracket 14, 14A for retaining the industrial light at a fixed location. The mounting brackets 14, 14A comprise an engagement aperture 82 corresponding to each of the plurality of spring-loaded pins 52, a retainment aperture 84 associated with each engagement aperture, and an inclined channel 86 connecting each engagement aperture with its associated retainment aperture. A head 58 of each of the spring-loaded pins 52 is inserted through a corresponding one of the engagement apertures 82 and then moved through the associated inclined channel 88 until it is seated within the associated retainment aperture 84. This removably attaches the industrial light 10 to the mounting bracket 14, 14A. The mounting bracket 14, 14A forms a pocket 88 around each retainment aperture 84 in which the head portion 58 of the corresponding spring-loaded pin 52 is positioned when the industrial light 10 is attached to the mounting bracket.

Each spring-loaded pin 52 includes a first end fixed to the industrial light 10 and a second end forming the enlarged head 58. A washer 56 is slidable along at least a portion of the pin 52, and a spring 54 is disposed about the pin between the industrial light and the washer. The enlarged head 58 of each pin 52 is smaller in diameter than the corresponding engagement aperture 82, and larger in diameter than the corresponding retainment aperture 84. The washer 56 of each spring-loaded pin 52 is larger in diameter than either of the corresponding engagement aperture 82 and retainment aperture 84.

It should also be appreciated that the specific configuration of the novel mounting system may be inverted or flipped so that the spring-loaded pins 52 are associated with the fixed location or fixed surface, and the mounting bracket 14, 14*a* is associated with the industrial light 10. Thus, the present invention is directed to a system for mounting comprising a plurality of spring-loaded pins extending from one of either the industrial light or the fixed surface, and a mounting bracket associated with the other of either the industrial light or the fixed surface. In either configuration, the function and operation of the snap and turn mounting system is identical.

Although several embodiments have been described in detail for purposes of illustration, various modifications may be made to each without departing from the scope and spirit of the invention. Accordingly, the invention is not to be limited, except as by the appended claims.

What is claimed is:

1. A system for mounting an industrial light to a fixed surface, comprising:
   - a plurality of spring-loaded pins extending from one of either the industrial light or the fixed surface; and
   - a mounting bracket associated with the other of either the industrial light or the fixed surface, the mounting bracket comprising:
   - an engagement aperture corresponding to each of the plurality of spring-loaded pins;
   - a retainment aperture associated with each engagement aperture; and
   - an inclined channel connecting each engagement with its associated retainment aperture;
   - wherein a head of each of the spring-loaded pins is inserted through a corresponding one of the engagement apertures and then moved through the associated inclined channel until it is seated within the associated retainment aperture, in order to removably attach the industrial light to the mounting bracket.

2. The mounting system of claim 1, wherein the mounting bracket forms a pocket around each retainment aperture in which a head of the corresponding spring-loaded pin is positioned when the industrial light is attached to the mounting bracket.

3. The mounting system of claim 1, wherein each spring-loaded pin includes a pin having a first end fixed to the industrial light and a second end forming an enlarged head, a washer slidable along at least a portion of the pin, and a spring disposed about the pin between the industrial light and the washer.

4. The mounting system of claim 2, wherein the enlarged head of each pin is smaller in diameter than the corresponding engagement aperture, and larger in diameter than the corresponding retainment aperture.

5. The mounting system of claim 4, wherein the washer of each spring-loaded pin is larger in diameter than the corresponding engagement aperture and retainment aperture.

6. The mounting system of claim 1, wherein each inclined channel is linear.

7. The mounting system of claim 1, wherein each inclined channel is curvilinear.

8. The mounting system of claim 1, wherein the industrial light comprises:

an inner heat sink conductively coupled to a lighting subassembly;

a plurality of cooling fins conductively coupled to and extending away from the inner heat sink; and an outer heat sink coupled to the cooling fins and offset from the inner heat sink, the outer heat sink comprising a lower heat sink coupled to a first set of cooling fins mounted to the inner heat sink, and an upper heat sink coupled to a second set of cooling fins.

9. The mounting system of claim 8, including at least one air vent extending through the outer heat sink and aligned with at least one of the first set of cooling fins.

10. The mounting system of claim 9, wherein the at least one air vent comprises a plurality of air vents aligned with a corresponding plurality of the first set of cooling fins.

11. The mounting system of claim 10, wherein the first and second sets of cooling fins are offset from one another.

12. The mounting system of claim 8, wherein the lighting subassembly includes a plurality of LEDs electrically coupled to a printed circuit board (PCB) attachable to a conductive mount.

13. The mounting system of claim 8, including a cap coupled to the inner heat sink to environmentally encapsulate the lighting subassembly, wherein the plurality of spring-loaded pins extend from the cap.

14. The mounting system of claim 13, wherein the cap comprises a light dispersing lens having an optical diffuser surface area providing no glare uniform lighting.

15. The mounting system of claim 8, wherein the surface area of the outer heat sink is relatively larger than the surface area of the inner heat sink.

16. A system for mounting an industrial light to a fixed surface, comprising:

a plurality of spring-loaded pins extending from one of either the industrial light or the fixed surface; and a mounting bracket associated with the other of either the industrial light or the fixed surface, the mounting bracket comprising:

an engagement aperture corresponding to each of the plurality of spring-loaded pins;

a retainment aperture associated with each engagement aperture; and an inclined channel connecting each engagement with its associated retainment aperture;

wherein a head of each of the spring-loaded pins is inserted through a corresponding one of the engagement apertures and then moved through the associated inclined channel until it is seated within the associated retainment aperture, in order to removably attach the industrial light to the mounting bracket;

wherein the mounting bracket forms a pocket around each retainment aperture in which a head of the corresponding spring-loaded pin is positioned when the industrial light is attached to the mounting bracket; and wherein each spring-loaded pin includes a pin having a first end fixed to the industrial light and a second end forming an enlarged head, a washer slidable along at least a portion of the pin, and a spring disposed about the pin between the industrial light and the washer.

17. The mounting system of claim 16, wherein the enlarged head of each pin is smaller in diameter than the corresponding engagement aperture, and larger in diameter than the corresponding retainment aperture and wherein the washer of each spring-loaded pin is larger in diameter than the corresponding engagement aperture and retainment aperture.

18. The mounting system of claim 16, wherein each inclined channel is linear.

19. The mounting system of claim 16, wherein each inclined channel is curvilinear.

20. The mounting system of claim 16, wherein the industrial light comprises:

a conductive mount for retaining a lighting subassembly having a plurality of LEDS electrically coupled to a printed circuit board (PCB);

an inner heat sink coupled to the conductive mount; and an outer heat sink coupled to the cooling fins and offset from the inner heat sink, the outer heat sink comprising a lower heat sink coupled to a first set of cooling fins mounted to the inner heat sink and an upper heat sink coupled to a second set of cooling fins.

21. The mounting system of claim 20, including at least one air vent extending through the outer heat sink and aligned with at least one of the first set of cooling fins, wherein the at least one air vent comprises a plurality of air vents aligned with a corresponding plurality of the first set of cooling fins, and wherein the first and second sets of cooling fins are offset from one another.

22. The mounting system of claim 20, wherein each LED comprises a high brightness LED chip surface mounted to the PCB, and including a light dispersing lens arranged to encapsulate the lighting subassembly with the inner heat sink, the lens having an optical diffuser surface area providing no glare uniform lighting.

23. The mounting system of claim 20, including a safety circuit coupled to the lighting subassembly having a temperature sensor, a voltage sensor and/or current sensor, and a kill switch that automatically activates when the temperature sensor determines a threshold temperature has been exceeded, the voltage sensor determines a threshold voltage has been exceeded, or the current sensor determines that a threshold current has been exceeded.

* * * * *